United States Patent [19]

Forester

[11] Patent Number: 5,000,836

[45] Date of Patent: Mar. 19, 1991

[54] METHOD AND COMPOSITION FOR RETARDING COKE FORMATION DURING PYROLYTIC HYDROCARBON PROCESSING

[75] Inventor: David R. Forester, Conroe, Tex.

[73] Assignee: Betz Laboratories, Inc., Trevose, Pa.

[21] Appl. No.: 412,368

[22] Filed: Sep. 26, 1989

[51] Int. Cl.[5] ..... C10G 45/08

[52] U.S. Cl. ..... 208/48 AA; 208/113; 208/121; 585/469; 585/648; 585/651; 585/950

[58] Field of Search ..... 208/48 AA, 113, 121; 585/950, 648, 651

[56] References Cited

U.S. PATENT DOCUMENTS

| | | | |
|---|---|---|---|
| 1,847,095 | 3/1932 | Mittasch | 585/415 |
| 2,063,596 | 2/1952 | Feiler | 585/403 |
| 2,399,540 | 4/1946 | Carr | 585/648 |
| 2,621,216 | 8/1950 | White | 260/683.3 |
| 3,531,394 | 9/1970 | Koszman | 208/48 |
| 3,591,484 | 7/1971 | Peck et al. | 208/48 AA |
| 4,105,540 | 8/1978 | Weinland | 208/48 |
| 4,116,812 | 9/1978 | Godar et al. | 208/48 |
| 4,243,417 | 1/1981 | Grourke et al. | 106/14.13 |
| 4,285,803 | 8/1981 | Braun et al. | 208/48 |
| 4,370,221 | 1/1983 | Patmore et al. | 208/112 |
| 4,404,087 | 9/1983 | Reed et al. | 208/48 |
| 4,431,520 | 2/1984 | Giuliani et al. | 208/48 AA |
| 4,507,196 | 3/1985 | Reed et al. | 208/48 |
| 4,551,227 | 11/1985 | Porter et al. | 208/48 |
| 4,552,643 | 11/1985 | Porter et al. | 208/48 |
| 4,613,372 | 9/1986 | Porter et al. | 106/1.13 |
| 4,666,583 | 5/1987 | Porter et al. | 208/48 |
| 4,680,421 | 7/1987 | Forester et al. | 585/648 |
| 4,724,064 | 2/1988 | Reid | 208/48 AA |
| 4,747,931 | 5/1988 | Forester et al. | 208/14 |
| 4,756,819 | 7/1988 | Bousquet et al. | 208/48 AA |
| 4,756,820 | 7/1988 | Reid et al. | 208/48 |

*Primary Examiner*—Helane E. Myers

*Attorney, Agent, or Firm*—ALexander D. Ricci; Bruce E. Peacock

[57] ABSTRACT

Methods and compounds for inhibiting coke formation in pyrolytic reactors and furnaces are disclosed wherein a molybdenum coke retarding treatment is used. Optionally, but preferably, a boron compound is used in conjunction with the molybdenum to provide optimal coke retarding performance.

14 Claims, No Drawings

METHOD AND COMPOSITION FOR RETARDING COKE FORMATION DURING PYROLYTIC HYDROCARBON PROCESSING

FIELD OF THE INVENTION

The present invention pertains to methods and compositions for inhibiting the formation and deposition of coke deposits during the high temperature processing or cracking of hydrocarbons by the use of molybdenum or molybdenum/boron sources in a liquid carrier.

BACKGROUND OF THE INVENTION

Coke deposition is generally experienced when hydrocarbon liquids and vapors contact the hot metal surfaces of processing equipment. While perhaps not entirely technically understood, because of the complex makeup of the hydrocarbons, the hydrocarbons at elevated temperatures and in contact with hot metallic surfaces undergo various changes through either chemical reactions and/or decomposition of various unstable components of the hydrocarbon. The undesired products in many instances include coke, polymerized products, deposited impurities and the like. Whatever the undesired product that may be formed, the result is the same, i.e., reduced economies of the process. If these deposits are allowed to remain unchecked, heat transfer, throughput and overall productivity are detrimentally effected. Moreover, downtime is likely to be encountered due to the necessity of either replacing and/or cleaning of the affected parts of the processing system.

While the formation and type of undesired products are dependent upon the hydrocarbon being processed and the conditions of the processing, it may generally be stated that such products can be produced at temperatures as low as 100° F.; but are much more prone to formation as the temperature of the processing system and the metal surfaces thereof in contact with the hydrocarbon increase. At these temperatures, coke formation is likely to be produced regardless of the type hydrocarbon being charged. The type coke formed, i.e., amorphous, filamentous or pyrolytic, may vary somewhat; however, the probability of the formation of such is quite high.

As indicated in U.S. Pat. Nos. 3,531,394 and 4,105,540 the teachings of which are incorporated herein by reference, coke formation and deposition are common problems in ethylene (olefin) plants which operate at temperatures where the metal surfaces in contact with the hydrocarbon are sometimes at 1600° F. and above. The problem is prevalent in the cracking furnace coils as well as in the transfer line exchanger where pyrolytic type coke formation and deposition is commonly encountered. Ethylene plants, often referred to generally as "olefin plants", originally produced simple olefins such as ethylene, propylene, butanes and butadiene from a feed of ethane, propane, butanes and mixtures thereof. Later developments in the area of technology however, have led to the cracking of heavier feedstocks, because of their availability, to produce aromatics and pyrolysis gasoline as well as light olefins. Feedstocks now include light naphtha, heavy naphtha and gas oil. According to the thermal cracking processes utilized in olefin plants, the feedstocks are cracked generally in the presence of steam in tubular pyrolysis furnaces The feedstock is preheated, diluted with steam and the mixture heated in the pyrolysis furnace to about 1500° F. and above, most often in the range of 1500° F. to 1650° F. The effluent from the furnace is rapidly quenched by direct means or an exchanger which are used to generate high pressure steam at 400 to 800 psig for process use. This rapid quench reduces the loss of olefins by minimizing secondary reactions. The cooled gas then passes to the prefractionator where it is cooled by circulating oil streams to remove the fuel oil fraction. In some designs, the gas leaving the quench exchanger is further cooled with oil before entering the prefractionator. In either case, the heat picked up by the circulating oil stream is used to generate steam and to heat other process streams. The mixture of gas and steam leaving the prefractionator is further cooled in order to condense the steam and most of the gasoline product in order to provide reflux for the prefractionator. Either a direct water quench or heat exchanger are used for this cooling duty.

After cooling, cracked gas at, or close to atmospheric pressure, is compressed in a multistage compression system to much higher pressures. There are usually four or five stages of compression with interstage cooling and condensate separation between stages. Most plants have hydrocarbon condensate stripping facilities. Condensate from the interstage knockout drums is fed to a stripper where the $C_2$ hydrocarbons and lighter, are separated. The heavier hydrocarbons are fed to the depropanizer.

PRIOR ART

A variety of approaches have been proposed to eliminate coke formation during the elevated temperature processing of hydrocarbonaceous mediums. For example, U.S. Pat. No. 4,680,421 (Forester et al—of common assignment herewith) teaches utilization of ammonium borates, specifically ammonium biborate and ammonium pentaborate that are preferably dissolved in a glycollic solvent. See also U.S. Pat. No. 4,747,931 (Forester et al). Of similar import is U.S. Pat. No. 4,756,820 (Forester et al —also of common assignment herewith) which discloses that boron oxides, borates, borate esters, peroxyborates, boranes, organoboranes, borazine and salts of boron may be used.

In U.S. Pat. No. 4,370,221 (Patmore, et al) processes for hydrocracking heavy oils where coke forming molecules such as asphaltenes are already present are disclosed. Also, substantial sulfur, nitrogen and metals containing compounds are present in these heavy oils. In the disclosure, a catalyst is slurried with the charge stock and is alleged to reduce sulfur content and reduce coke formation at temperatures between 752° and 932° F. The disclosed catalysts are cobalt and molybdenum compounds on a solid carrier such as coal. This patent requires the use of coal added to the heavy hydrocarbon and added hydrogen to reduce deposits. In contrast, in the present invention, the operating temperatures are much greater (i.e., 1400° F. and higher) and the feedstocks are much lower boiling materials containing almost no sulfur, nitrogen or metals containing compounds. Also, the use of coal and/or the addition of hydrogen are not required for the process and would, in fact, be undesirable.

Molybdenum cracking catalysts are known in the art as evidenced by U.S. Pat. No. 4,285,803 (Braun et al). In this patent disclosure, molybdenum and other catalysts are used to convert hydrocarbonaceous black oils into hydrocarbon-soluble lower-boiling normally liquid products. The hydrocarbon conversion conditions include a temperature from about 400° F. to about 900° F. and a pressure of about 100 psig to about 5,000 psig.

Additional prior art patents that may be of interest include U.S. Pat. Nos. 4,507,196 (Reed et al); 4,243,417 (Grouke et al); 3,531,394 (Kozman); 4,105,540 (Weinland); 4,116,812 (Godar); 2,063,596 (Feiler); 1,847,095 (Mittasch); 4,404,087 (Reed et al); 3,591,484 (Peck et al) and 2,621,216 (White). Other patents that may be of tangential interest include U.S. Pat. Nos. 4,551,227 (Porter et al); 4,552,643 (Porter et al); 4,613,372 (Porter et al) and 4,666,583 (Porter et al).

Despite the prior art efforts, there remains a need for an inexpensive, but effective treatment for use to inhibit the formation and deposition for coke particles on heated surfaces in a high temperature (i.e., ≧1400° F.) pyrolysis furnace that is adapted to crack petroleum gases or liquids to make olefins such as in the high temperature cracking of propane to make ethylene/propylene.

DESCRIPTION OF THE INVENTION

Generally, the invention entails utilizing molybdenum to inhibit coke formation in pyrolytic processing applications. Optionally, but preferably, the molybdenum is conjointly used with a boron containing compound, or elemental boron, to provide optional coke retarding efficacy.

Any suitable form of molybdenum may be utilized to inhibit coke formation in accordance with the invention. Elemental molybdenum, inorganic molybdenum compounds and organic molybdenum compounds as well as mixtures of any two or more thereof are suitable sources of molybdenum. The term "molybdenum", as used herein, refers to any of these sources.

Examples of some suitable inorganic molybdenum compounds include: the oxides, $MoO_2$ and $MoO_3$; molybdic acid; molybdenum selenide; molybdenum telluride; molybdenum hydroxide; molybdenum disulfide; molybdenum halides or oxyhalides, such as $MoF_6$, $MoCl_5$ and $MoO_2Cl_2$ (not preferred due to formation of corrosive by products); phosphates, such as, molybdenum metaphosphate, mineral products such as molybdenite, $MoS_2$; wulfenite, Pb Mo $O_4$ and powellite Ca (MoW) $O_4$. Various molybdenum borides such as $MO_2B$, $MO_3B_2$, MoB, and $Mo_2B_5$ may also be mentioned. Preferred inorganic molybdenum compounds include the molybdates such as sodium and ammonium molybdate.

Examples of some organic molybdenum compounds which can be used include molybdenum acetylacetonate, molybdenum naphthenate and molybdenum 2-ethylhexanoate.

Optionally, but preferably, the molybdenum source is conjointly used with a source of boron. Any suitable form of boron may be used. Elemental boron, inorganic boron compounds and organic boron compounds as well as mixtures of any two or more thereof are suitable sources. The term "boron, as used herein, refers to any of these boron sources.

Illustrative of the boron compounds are the oxides such as the alkyl borates, metaborates, e.g. sodium, potassium, lithium metaborates, triethyl borate, trimethyl borate, boric acid and borate salts such as sodium tetraborate, potassium tetraborate, lithium tetraborate, zinc borate, ammonium borates such as ammonium biborate and ammonium pentaborate, etc., and hydrated salts of such compounds. Also, such compounds as $BO_2$, $BO_6$, metal salts containing boron oxides such as $Na_2B_4O_7.10H_2O$, $K_2B_4O_7.10H_2O$, $K_2B_4O_7$; $LiBO_2$, $LiBO_2.H_2O$ etc. may be mentioned.

Materials like boron carbide, boron phosphide, boron nitride, boron halides, boron sulfide and the boron hydrides are also exemplary. Exemplary boride materials include the silicon borides and aluminum borides. Also utilizable are such compounds as the anhydrous and hydrated borate esters, peroxoborates, boranes, organoboranes and borazines.

The methods of the invention are adapted to inhibit the formation and deposition of coke on metallic surfaces in contact with a hydrocarbon (either in liquid or gaseous form) which surfaces reach temperatures of 1400° F. and above (most often 1500°-2050° F.) These temperatures are commonly encountered in olefin plants as earlier indicated. In these systems, the components of the furnace (pyrolytic) as well as the ancillary parts are composed of ferrous metal. Iron, as well as iron alloys such as low and high carbon steel, and nickel-chromium-iron alloys are customarily used for the production of hydrocarbon processing equipment such as furnaces, transmission lines, reactors, heat exchangers, separation columns, fractionators, and the like.

It has been found that coking during the high temperature cracking of hydrocarbons may be significantly reduced on heated stainless steel surfaces utilized in conjunction with the test system described infra by use of the molybdenum and molybdenum/boron treatments noted in the examples. Accordingly, it is to be expected that coking will also be reduced on iron, chromium and nickel based metallurgical surfaces in contact with pyrolysis products in high temperature pyrolytic furnaces.

The molybdenum or molybdenum/boron treatment may be added directly to the hydrocarbon feedstock or charge before and/or during cracking, or the treatment may be mixed with steam carried to the cracking zone in accordance with conventional cracking techniques.

The molybdenum or molybdenum/boron may be dissolved or dispersed in a suitable carrier liquid. Depending upon the particular compound utilized either polar or non-polar carrier liquids may be used. Preferred polar solvents comprise water, alcohols (methanol, ethanol, etc.) and glycols Examples of non-polar solvents include paraffinic or aromatic hydrocarbons such as light oil, heavy aromatic naphtha, and kerosene and the like.

Generally, the molybdenum is dissolved in a polar solvent in a concentration that will produce the necessary amount of molybdenum to the coke-prone environment to inhibit or reduce coking. Coking is a significant problem and if left untreated will eventually shut the operation down. Accordingly, it is desirable to ensure that the molybdenum or molybdenum/boron source content of the carrier solution or dispersion is high enough to ensure that an ample quantity of the molybdenum or molybdenum/boron treatment mixes with or is dispersed in the hydrocarbonaceous medium during the pyrolytic cracking process. Accordingly, product formulation lends itself to great flexibility.

The coke retarding product can contain, on a weight basis, from about 1-75% active materials (molybdenum or molybdenum and boron) either dissolved or dispersed in a carrier liquid, preferably polar solvent. To assure maintenance of the solution or dispersion during storage and transport, stabilizing agents and/or preservatives may also be added to the formulation.

Generally, when the combined Mo and B treatment is desired, the Mo and B may be supplied in a weight ratio of Mo:B of 3-1:1-3 with a 1:1 combination being preferred. At present, based upon experimental data it is preferred to utilize a product of ammonium molybdate/ammonium biborate dissolved in ethylene glycol at a Mo:B weight ratio of about 1:1.

EXAMPLES

In order to establish the efficacy of the invention, various tests were conducted using a propane feedstock with dilution steam added to enhance cracking. The apparatus and procedure used for the testing were as follows:

APPARATUS

The High Temperature Fouling Apparatus (HTFA) consists of five subsections which together simulate the pyrolysis of gaseous hydrocarbons to make the light olefinic end products and the undesirable by-product, coke, that is formed on the heated metal surfaces during the pyrolysis reaction.

The feed preheat section is built of 316 stainless steel tubing and fittings and allows the mixing of nitrogen or oxygen containing gas with steam during the start up and shut down of the HTFA and the propane with steam during the actual test. Steam is supplied at 40 psig by a steam generator and nitrogen, oxygen containing gas, or propane are fed from compressed gas cylinders. The gases and steam are heated to about 300° F. at which point small amounts of water (blank test) or candidate material is slowly injected into the stream by a syringe pump. The gases/candidate material are further preheated to about 500° F. before flowing through a 13-foot long coiled 316SS tube inside an electrically heated furnace. The gases are heated at a furnace temperature of approximately 1880° F. and exit the furnace at 1150°-1450° F.

Following the furnace tube, the gases travel through the coker rod assembly. This consists of a 316SS rod which is electrically heated to 1500° F. while the gases flow around the heated rod inside a 316SS shell. The rod is electrically heated through a silicon controlled rectifier (SCR), then through two 4 to 1 stepdown transformers in series to achieve low voltage (3-4 volts), high amperage ($\approx$200 amps) heating of the rod. A temperature controller is used to achieve power control through the SCR to obtain a 1500° F. rod temperature.

Upon exiting the coker rod, the gases pass through a condenser coil and then through three knock-out flasks in ice baths to remove the water (steam) from the product gases. The small amount of remaining entrained water vapor in the gases is removed by passing through drierite granules.

The specific gravity of the product gas is determined in a gas densitometer and the gases are analyzed using gas chromatography to determine yields. The remaining gases are vented through a safety hood exhaust.

TEST PROCEDURE

The furnace was turned on and the temperature thereof was stabilized at 1300° F. while feeding nitrogen and steam. The coker rod was heated to 1500° F. The nitrogen was replaced with oxygen containing gas (air) and furnace temperatures were then slowly increased to 1500° F. over a period of ten minutes. Then the air was replaced with nitrogen and the coke inhibitor or water (blank), as the case may be, was injected into the mixed gas or steam line at about 300° F. gas temperature while the furnace temperature was slowly raised to 1880° F. over 20-25 minutes.

Then the nitrogen feed was gradually switched to propane feed over about 5 minutes. The temperature of the furnace dropped due to the propane cracking reaction and was allowed to increase to the maximum attainable furnace temperature (1880° F. or less) over approximately a 30-minute period. The product gases were analyzed by gas chromatography and the temperatures, flowrates, pressures and product gas gravity recorded every 35 minutes during the 160-minute test on propane/steam feed. Gases exit the furnace tube at about 1150° F.-1450° F. and exit the coker shell at about 975° F.-1000° F. temperatures.

During a normal 160 minute run, approximately 3200-3300 grams of propane were fed and 1000-2000 grams of steam fed (determined from the condensate collected) for hydrocarbon to steam rates of about 1.6:1 to 3.2:1.

Following shutdown and cooling, the furnace tube and coker shell were cleaned and the coke collected and weighed. The coke was burned to determine how much was non-coke (metal corrosion products). These corrosion products (gray matter) were analyzed to be 69 wt. % $Fe_3O_4$, 13 wt. % NiO, 15 wt. % $Cr_2O_3$, 1 wt. % $SiO_2$, 1 wt. % $MnO_2$ and 1 wt. % loss on ignition. The composition is similar to 316 SS (68.4% Fe, 18% Cr, 11% Ni, 2.5% Mo and 0.1% carbon). After a series of blank (water) and candidate material tests were conducted, a steam to coke relationship was determined for the blanks and the predicted coke values compared to observed coke values of the treatments to determine percent coke reduction. Results are indicated in Table I.

TABLE I

High Temperature Fouling Apparatus Results 1300-1500° F. Furnace Steam/Air Decoking; 1500-1880° F. Furnace Af/N2/Steam; 1880° F. Furnace Propane (0.5SCFM)/Steam/Af for 2.67 Hr.

| F.T.# Run # | Steam Ml/Min | Antifoulant (Mo or B, ppm) | Coke Gms | Gray Gms | Pred[1] Coke Gms | % Coke[2] Reduction |
|---|---|---|---|---|---|---|
| 18-16 | 7.71 | 7.5% NaMO04/EG (47) | 0.42 | 0.04 | 0.69 | 39 |
| 19-12 | 9.43 | 7.5% NaMO04/EG (42)a | 0.39 | 0.06 | 0.56 | 31 |
| 19-18 | 9.08 | 7.5% NaMO04/EG (44) | 0.27 | 0.20 | 0.59 | 54 |
| 24-11 | 9.56 | 7.5% NaMO04/EG (50) | 0.66 | 0.10 | 0.49 | -36 |
| 20-10 | 9.13 | 10% NH4Mo04/H20 (74) | 0.50 | 0.10 | 0.58 | 14 |
| 20-11 | 9.54 | 10% NH4Mo04/H20 (73) | 0.49 | 0.06 | 0.56 | 12 |
| 21-10 | 10.20 | 10% NH4Mo04/H20 (73) | 0.18 | 0.03 | 0.52 | 65 |
| 22-4 | 7.62 | 10% NH4Mo04/H20 (79)a | 0.52 | 0.11 | 0.71 | 25 |
| 22-19 | 8.69 | 10% NH4Mo04/H20 (71) | 0.40 | 0.19 | 0.61 | 35 |
| 24-9 | 8.44 | 10% NH4Mo04/H20 (88) | 0.20 | 0.09 | 0.55 | 64 |
| 25-5 | 8.91 | 10% NH4Mo04/H20 (86) | 0.31 | 0.09 | 0.52 | 41 |

TABLE I-continued

High Temperature Fouling Apparatus Results 1300–1500° F. Furnace Steam/Air Decoking; 1500–1880° F. Furnace Af/N2/Steam; 1880° F. Furnace Propane (0.5SCFM)/Steam/Af for 2.67 Hr.

| F.T.# Run # | Steam Ml/Min | Antifoulant (Mo or B, ppm) | Coke Gms | Gray Gms | Pred[1] Coke Gms | % Coke[2] Reduction |
|---|---|---|---|---|---|---|
| 26–10 | 5.57 | 10% NH4Mo04/H20 (97) | 0.58 | 0.33 | 0.84 | 31 |
| 30–8 | 10.15 | 10% NH4Mo04/EG (80) | 0.44 | 0.42 | 0.46 | 4 |
| 35–14 | 11.06 | 10% NH4Mo04/EG (103) | 0.49 | 1.56 | 0.67 | 27 |
| 37–8 | 11.87 | 10% NH4Mo04/EG (99) | 0.28 | 0.68 | 0.62 | 55 |
| 40–12 | 9.00 | 10% NH4Mo04/EG (95) | 0.65 | 0.78 | 0.82 | 21 |
| 35–16 | 13.59 | 5% NH4Mo04/17.5% NH4 Biborate (48,Mo;48,B) EG | 0.52 | 0.55 | 0.54 | 4 |
| 35–19 | 13.73 | 5% NH4Mo04/17.5% NH4 Biborate (48,Mo;48,B) | 0.05 | 4.53 | 0.54 | 91 |
| 36–7 | 10.43 | 5% NH4Mo04/17.5% NH4 Biborate (50,Mo;51,B) | 0.13 | 2.16 | 0.71 | 82 |

[a]ANTIFOULANT PLUGGED INJECTION LINE
[1]PREDICTED COKE = A/CONDENSATE RATE (ml/min) where A = 5.32 FOR FT'S (furnace tube) 18 to 22, 4.65 for FT'S 24 to 30 and 7.38 for FT'S 34 to 40.
[2]Coke Reduction = [1-COKE/PEDICTED COKE]*100
EG = ethylene glycol Average coke reductions obtained for each tested compound or combination of compounds are summarized in Table II.

TABLE II

Summary of Coke Reduction Effects of Molybdenum and Boron/Molybdenum Containing Compounds as Tested in The High Temperature Fouling Apparatus

| Compound | # of HFTA Runs | Metal (ppm) Range | Average Coke Red (%) | Mann-Whitney[1] Confidence Level |
|---|---|---|---|---|
| AMMONIUM MOLYBDATE | 12 | 71–103 | 33 | 99.9 |
| SODIUM MOLYBDATE | 4 | 42–50 | 22 | 93.7 |
| AMMONIUM MOLYBDATE/ AMMONIUM BIBORATE | 3 | 48–51 of B,Mo | 59 | 96.6 |
| BLANK | 62 | — | 0 | — |

[1]CONFIDENCE LEVEL THAT THE POOLED COKE REDUCTION LEVELS OF TREATED RUNS ARE GREATER THAN THE POOLED COKE REDUCTION LEVELS OF THE UNTREATED RUNS.

The confidence level that the pool of coke reductions for each set of treated runs was greater than the pool of coke reductions for the untreated control runs was determined using the well-known Mann-Whitney statistical procedure. As shown in Table II, the ammonium molybdate and combined ammonium molybdate/ammonium biborate treated runs exhibited Mann-Whitney confidence levels in excess of 95%, a level generally accepted as being significant. The sodium molybdate runs produced a confidence level slightly below the 95% level. However, it is thought that additional satisfactory sodium molybdate treated runs would increase its confidence level above 95%.

Accordingly, from the above, it is clear that the molybdenum compound treatments are effective as coke retarding treatments under the simulated pyrolysis conditions above noted. These treatments would be expected to perform well at commonly encountered pyrolytic temperatures such as from 1400°–2100° F. Desirably, the molybdenum compounds and the combined molybdenum/boron treatment compounds should be added to the pyrolytic steam and/or hydrocarbon feedstock so as to provide about 0.1–5000 ppm of the desired Mo metal or Mo metal and B combined treatment, per million parts of the hydrocarbon feedstock. Based upon experimental data presently available, a preferred feed range is from about 5–100 ppm Mo or Mo and B per million parts feedstock.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A method of inhibiting the formation and deposition of pyrolytic coke on the heated metal surfaces of the structural and associated parts of a pyrolysis furnace which is being used to crack a petroleum feedstock to produce lower and/or olefinic hydrocarbon fractions, which method comprises adding to the feedstock a pyrolytic coke inhibiting amount of molybdenum said surfaces being heated, during said cracking, to a temperature of about 1400° F. or higher.

2. A method as recited in claim 1 wherein the hydrocarbon is mixed with steam for enhancement of the cracking thereof.

3. A method as recited in claim 1 wherein said molybdenum is added to said feedstock during cracking thereof.

4. A method as recited in claim 1 wherein said molybdenum is added to said feedstock prior to cracking.

5. A method as recited in claim 1 wherein said molybdenum is added to said feedstock in an amount of about 0.1–5000 parts of said molybdenum per million parts of hydrocarbon.

6. A method as recited in claim 5 wherein said molybdenum is added in an amount of about 5–100 ppm per million parts of said feedstock.

7. A method as recited in claim 1 wherein said molybdenum is chosen from the group consisting of elemental molybdenum, inorganic molybdenum compounds and organic molybdenum compounds.

8. A method as recited in claim 7 wherein said molybdenum comprises a molybdate compound.

9. A method as recited in claim 8 wherein said molybdate comprises sodium or ammonium molybdate.

10. A method as recited in claim 1 further comprising adding to the feedstock a coke inhibiting amount of boron.

11. A method as recited in claim 10 wherein the weight ratio of molybdenum: boron added to said feedstock is from 1-3:3-1 and wherein about 0.1-5,000 parts of the combination of molybdenum and boron is added to said hydrocarbon.

12. A method as recited in claim 11 wherein said molybdenum is a member selected from the group consisting of sodium and ammonium molybdates and wherein said boron compound comprises ammonium biborate or ammonium pentaborate.

13. A method as recited in claim 1 wherein the feedstock comprises ethane, propane, butane, light naphtha, heavy naphtha, gas oils or mixtures thereof.

14. A method as recited in claim 13 wherein the feedstock comprises ethane, propane, or butane or mixtures thereof.

* * * * *